US007588122B2

(12) United States Patent
Brittingham

(10) Patent No.: US 7,588,122 B2
(45) Date of Patent: Sep. 15, 2009

(54) ORIENTATION APPARATUS FOR ECCENTRIC FIREARM NOISE SUPPRESSOR AND ASSEMBLY METHOD

(76) Inventor: Kevin Tyson Brittingham, 1434 Hillcrest Rd., Norcross, GA (US) 30093

( * ) Notice: Subject to any disclaimer, the term of this patent is extended or adjusted under 35 U.S.C. 154(b) by 200 days.

(21) Appl. No.: 11/894,206

(22) Filed: Aug. 20, 2007

(65) Prior Publication Data

US 2009/0050403 A1 Feb. 26, 2009

(51) Int. Cl.
*F41A 21/38* (2006.01)

(52) U.S. Cl. ..... 181/223; 89/14.2; 89/14.4

(58) Field of Classification Search ..... 181/223; 89/14.2, 14.4
See application file for complete search history.

(56) References Cited

U.S. PATENT DOCUMENTS 1,605,864 A * 11/1926 Steinegger ..... 89/14.3
3,677,132 A * 7/1972 Plenge ..... 89/14.2
4,384,507 A * 5/1983 Finn ..... 89/14.4
5,559,302 A * 9/1996 Latka ..... 89/14.05
6,176,032 B1 * 1/2001 Cohen et al. ..... 42/96
6,701,820 B2 * 3/2004 Fluhr ..... 89/14.4
6,948,415 B2 * 9/2005 Matthews et al. ..... 89/14.4
2006/0060076 A1 * 3/2006 Dueck et al. ..... 89/14.4
2007/0095198 A1 * 5/2007 Dater et al. ..... 89/14.2

* cited by examiner

*Primary Examiner*—Walter Benson
*Assistant Examiner*—Jeremy Luks
(74) *Attorney, Agent, or Firm*—Greenebaum Doll & McDonald PLLC; Glenn D. Bellamy

(57) ABSTRACT

An apparatus and method to install and index an eccentric noise suppressor. Once a noise suppressor is threadedly secured about the bore of a firearm a retention collar may be released by un-securing a retention cap. Releasing the tension which is placed on the retention collar affords the user an option of orienting the noise suppressor to any position which may be achieved by rotating the noise suppressor about the longitudinal axis of the barrel. This allows the user to place an eccentric noise suppressor in a position which does not obscure the sites of a handgun.

9 Claims, 3 Drawing Sheets

ORIENTATION APPARATUS FOR ECCENTRIC FIREARM NOISE SUPPRESSOR AND ASSEMBLY METHOD

BACKGROUND OF THE INVENTION

1. Field of Invention

This invention generally relates to noise suppressors, specifically to systems for orienting threadedly secured, eccentric noise suppressors onto a handgun barrel.

2. Prior Art

Various systems are known in the firearms art for attaching a noise suppressor to a hand gun, and specifically for removably attaching a noise suppressor to a barrel which is threaded on the muzzle end of a hand gun barrel. There nevertheless exists a need for improving such systems.

The majority of handgun noise suppressors found in the prior art have a bore which is concentric to the out side diameter of the noise suppressor housing. Traditional cylinder shaped noise suppressors obscure the sites located on the host weapon. Military, police and civilian consumers are interested in noise suppressor designs which do not obscure the sites of the host hand gun. Threadedly securing a noise suppressor which is of an eccentric variety creates one very acute problem. The length, pitch and timing of the threads commonly machined onto handgun barrels vary between production runs; there is no easy way to orient an eccentric noise suppressor on a variety of firearm without custom fitting the noise suppressor to each handgun. Custom fitting a noise suppressor is expensive and not practical for military, police or civilian users who may need to use the noise suppressor on a variety of different handguns. The apparatus and method which I am providing allows the users of a noise suppressor equipped with my apparatus to properly index the noise suppressor to the handgun being used at the time.

3. Objects and Advantages

Accordingly several objects and advantages of the present invention are (a) to provide an apparatus and method which will afford the end user an option of properly orienting an eccentric noise suppressor so that it is not excessively obscuring the sites of a hand gun (b) to provide an orientation apparatus and method which will work with barrels using a variety of thread pitches as a way of removably securing a noise suppressor (c) to provide an apparatus which allows the silencer to be rotated and secured on a 360 degree axis allowing nearly unlimited options for noise suppressor orientation.

(d) to provide a system for orienting a noise suppressor which is not limited to a single position of orientation.

Still further objects and advantages will become apparent from a consideration of the ensuing description and drawings.

SUMMARY

The present invention utilizes an insert which provides a female thread for removably securing a noise suppressor. The aforementioned insert has two machined flats which interface with two flats on a collar that circumferentially covers the threaded insert. The collar is tapered so that when it is pressed into a housing the collar and thereby the threaded insert are rotationally restrained. A cap which may be threadedly secured is used to provide downward pressure against the collar thereby pressing it into the housing. The housing cap may be unsecured and pulled in a path which is longitudinal to the noise suppressor which will result in the collar becoming unsecured. Once this is accomplished the housing and thereby the noise suppressor may be rotated into a desired position. Once the noise suppressor is properly oriented the housing cap is removably secured to prevent the insert and thereby the noise suppressor from rotating further.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
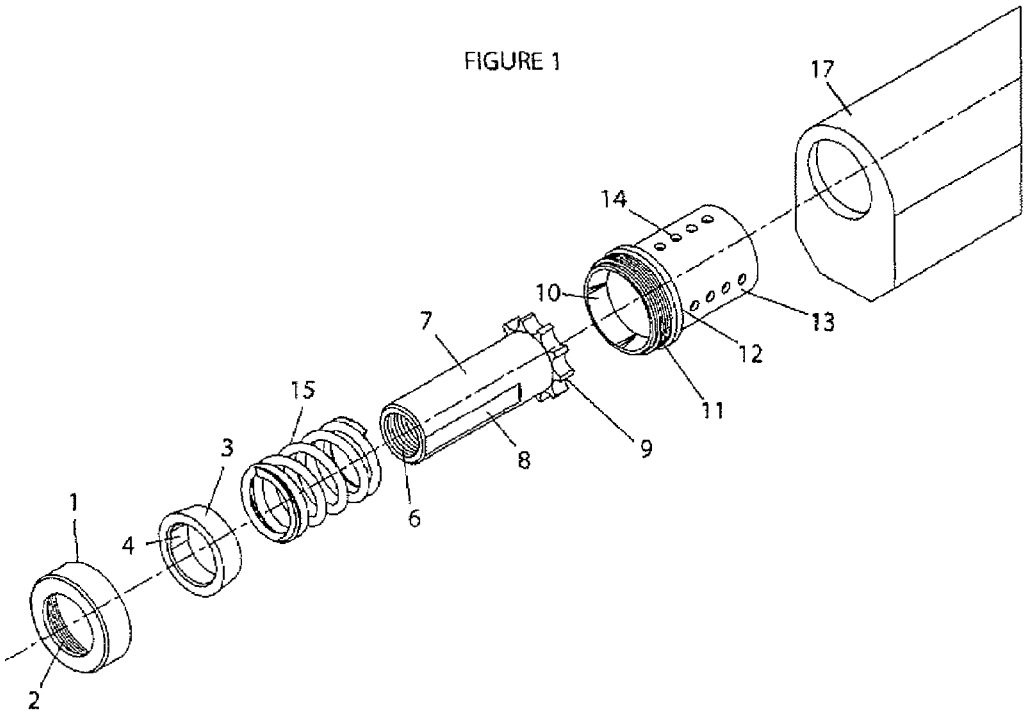
FIG. 1 shows an exploded diagram of the orientation apparatus indicating how the parts orient to each other during assembly.

Starting with FIG. 1, there is an illustration of an exploded view of the proposed apparatus. The cylindrical housing 13, piston 7, tapered collar 3, spring 15 and the retention cap 1 are the key elements of my proposed invention. Also shown is the proper sequence that each item which is encompassed within the proposed apparatus is to be placed within the cylindrical housing 13.

Figure 2:
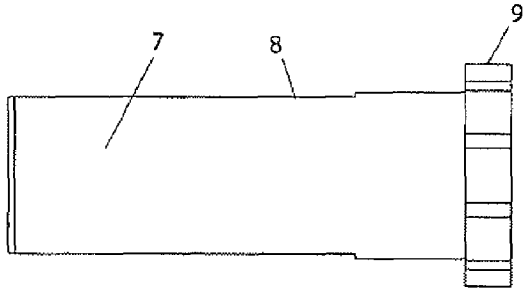
FIG. 2 shows a horizontal side view of the piston.
Figure 3:
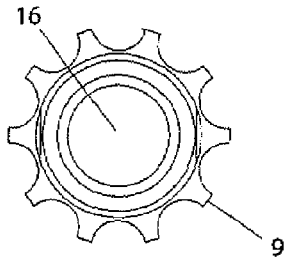
FIG. 3 shows an external front view of the piston shown in FIG. 2.
Figure 4:
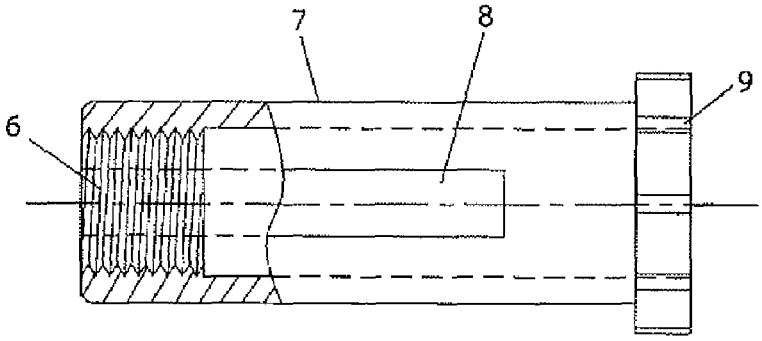
FIG. 4 shows a partially cut away, side view of the preferred embodiment piston shown in FIG. 2.

Shown in FIG. 2, 3, 4, are a variety of views of the preferred embodiment piston 7. Illustrated is the piston indexing flats 8 and the orientation notches 9. The top view of FIG. 3 shows the piston opening 16 where a bullet would exit the piston and pass through the cylindrical housing 13 and the noise suppressor 17. FIG. 4. illustrates the location of mounting threads 6 within the piston 7.

Figure 5:
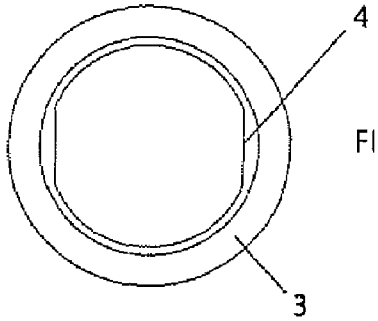
FIG. 5 shows a rear view of the tapered collar.
Figure 6:
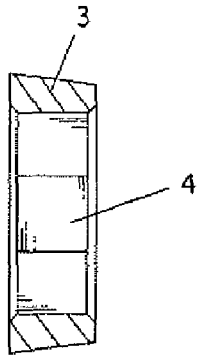
FIG. 6 shows a side sectional view of the tapered collar shown in FIG. 5.
Figure 7:
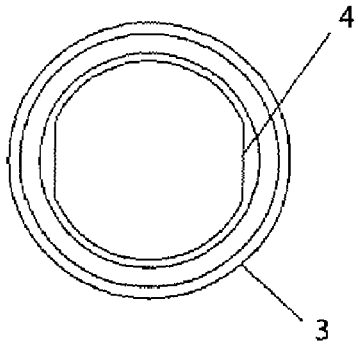
FIG. 7 shows a front view of the tapered collar shown in FIG. 5.

The tapered collar 3 is illustrated in FIG. 5, 6, 7. The indexing flats 4 which guide the piston 7 and match up to the piston indexing flats 8 are shown. When tapered collar 3 is placed within the cylindrical housing opening 10 and secured with the retention cap 1 it is rotationally restrained.

Figure 8:
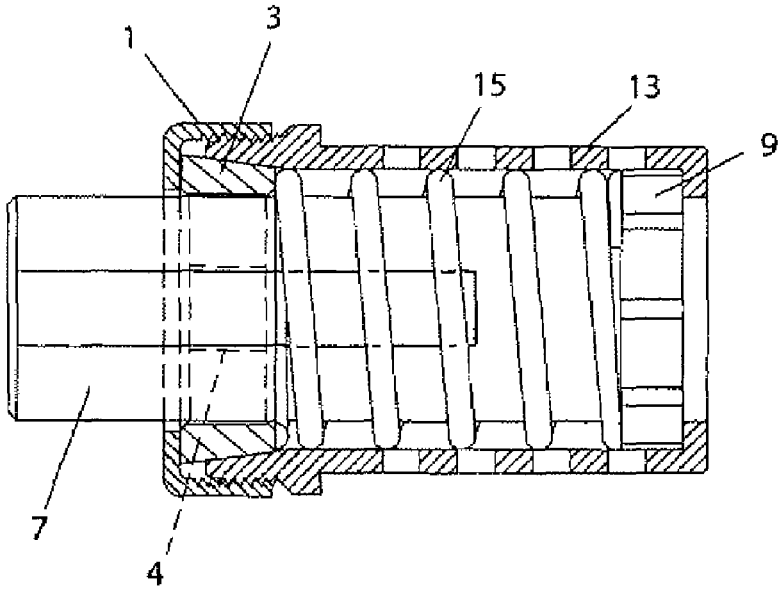
FIG. 8 shows a cutaway view of the fully assembled orientation apparatus.

Shown in FIG. 8 is the proposed apparatus fully assembled. To assemble the apparatus the cylindrical housing 13 must be secured within the noise suppressor 17 shown in FIG. 1. Proper placement of the cylindrical housing 13 is achieved by machining a mount shoulder 12 on the cylindrical housing 13. The mount shoulder 12 will provide proper seating for the cylindrical housing 13. The cylindrical housing 13 may be threadedly secured within the noise suppressor or welded. Piston 7 is inserted into the cylindrical housing 13. The spring 15 is a coil spring designed to slide around the piston 7 and fit within the confines of the cylindrical housing 13. A tapered collar placed onto the piston with indexing flats 4 interfacing with the piston indexing flats 8. The tapered collar is then slid down the piston. The retention cap 1 is threadedly secured to the cylindrical housing 13 by means of the retention cap threads 2 and the housing threads 13. With the retention cap 1 threadedly secured it provides pressure against the tapered collar 3 thereby preventing the piston 6 from rotating within the cylindrical housing 13.

Thus, there has been described a preferred embodiment of an apparatus to removably secure and orient a noise suppressor onto the barrel of a handgun. The describe apparatus affords the user virtually unlimited options for noise suppressor orientation. Other embodiments of the present invention, and variations of the embodiment described herein, may be developed without departing from the essential characteristics thereof. Accordingly, the invention should be limited only by the scope of the claims listed below.

CONCLUSION, RAMIFICATION, AND SCOPE

Accordingly the reader will see that, according to the invention, I have provided a system for orienting the noise suppressor body or baffle stack, based on design, to the host weapon. I have afforded the user of my proposed apparatus the ability to orient a noise suppressor to a host firearm without timing the threads of the barrel and noise suppressor. My proposed device does not limit the positions which the noise suppressor may be mounted. My device when used in conjunction with an eccentric noise suppressor allows the user to adjust the silencer in such a way as to not unnecessarily obstruct the sites of the host firearm.

While my above drawings and description contain many specificities, these should not be construed as limitations on the scope of the invention, but rather as an exemplification of one preferred embodiment thereof. For example, if the noise suppressor body was of a traditional cylinder design the orientation of the internal baffles, well known in the prior art, could be changed to affect the point of impact of all projectiles leaving the host firearm.

Accordingly, the scope of the invention should be determined not by the embodiments illustrated, but by the appended claims and their legal equivalents."

The invention claimed is:

1. An attachment orientation apparatus for a firearm noise suppressor, comprising:

a substantially cylindrical housing mountable to a noise suppressor having an open end and configured to receive a piston;

a piston having an end configured for threaded attachment to a firearm barrel and configured to be received by said cylindrical housing and having at least one longitudinally-extending external indexing surface;

an tapered annular collar configured to interface with said housing open end and having at least one internal indexing surface configured to engage the piston's indexing surface; and a retention cap configured to adjustably secure the collar tightly against the open end of the housing and rotationally restrain the collar relative to the housing, the cap having an opening sized to allow at least a portion of said piston to pass therethrough, whereby said orientation apparatus provides infinite adjustment for the rotational orientation of an affixed noise suppressor by selective securement of the collar against the housing by the retention cap.

2. The orientation apparatus of claim 1, wherein said piston is configured for slidable reciprocation within the housing between positions in which a variable portion of the piston extends outwardly of the housing.

3. The orientation apparatus of claim 2, further comprising a spring member configured to bias the piston toward a position at which any portion of the piston extending outwardly of the housing is minimized.

4. The orientation apparatus of claim 2, wherein said piston includes a larger portion sized to engage an inner surface of the housing and a smaller portion sized to pass through the retention cap.

5. The orientation apparatus of claim 1, wherein said retention cap is threadedly secured to the cylindrical housing.

6. The orientation apparatus of claim 1, wherein said housing includes a tapered portion at its open end configured to confront a tapered surface of the annular collar.

7. A method for joining components of an attachment orientation apparatus for a firearm noise suppressor, comprising the steps of:

providing a substantially cylindrical housing mountable to a noise suppressor having an open end and configured to receive a piston;

providing a piston having an end configured for threaded attachment to a firearm barrel and configured to be received by said cylindrical housing and having at least one longitudinally-extending external indexing surface;

providing an tapered annular collar configured to interface with said housing open end and having at least one internal indexing surface;

providing a retention cap configured to adjustably secure the collar tightly against the open end of the housing and rotationally restrain the collar relative to the housing, the cap having an opening sized to allow at least a portion of said piston to pass therethrough, engaging the indexing surfaces of the piston and collar together and selectively rotationally positioning the collar to the housing with the retention cap; and securing the collar in the selected rotational orientation by tightening the securement of the collar against the open end of the housing with the retention cap.

8. The method of claim 7, wherein said piston is configured for slidable longitudinal reciprocation within the housing between positions in which a variable portion of the piston extends outwardly of the housing.

9. The method of claim 8, further comprising the step of providing a spring member configured to bias the piston toward a position at which any portion of the piston extending outwardly of the housing is minimized.

* * * * *